US008999900B2

(12) United States Patent
Iida et al.

(10) Patent No.: US 8,999,900 B2
(45) Date of Patent: Apr. 7, 2015

(54) TWO-COMPONENT ANTI-SEIZURE AGENT FOR HOT METAL WORKING PROCESS, AND METHOD OF MANUFACTURING SEAMLESS PIPE USING THEREOF

(75) Inventors: Sumio Iida, Osaka (JP); Masami Imamura, Osaka (JP); Yuuji Tanaka, Osaka (JP); Kazuhiro Shimoda, Osaka (JP); Hirofumi Hori, Osaka (JP); Akira Motoki, Kanagawa (JP); Shizuo Mori, Kanagawa (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 1609 days.

(21) Appl. No.: 11/883,746

(22) PCT Filed: Feb. 9, 2006

(86) PCT No.: PCT/JP2006/002280

§ 371 (c)(1),
(2), (4) Date: Mar. 7, 2008

(87) PCT Pub. No.: WO2006/085599

PCT Pub. Date: Aug. 17, 2006

(65) Prior Publication Data

US 2009/0054279 A1 Feb. 26, 2009

(30) Foreign Application Priority Data

Feb. 9, 2005 (JP) ..... 2005-033015

(51) Int. Cl.
*C10M 173/00* (2006.01)
*C10M 125/26* (2006.01)
*C10M 173/02* (2006.01)

(52) U.S. Cl.
CPC ..... *C10M 125/26* (2013.01); *C10M 173/02* (2013.01); *C10M 2201/062* (2013.01);

(Continued)

(58) Field of Classification Search
CPC ..... C10M 173/00
USPC ..... 508/107, 110, 143, 161, 162, 173, 459, 508/545
See application file for complete search history.

(56) References Cited

U.S. PATENT DOCUMENTS 4,759,861 A * 7/1988 Ogura et al. ..... 508/390
5,859,124 A * 1/1999 Yorifuji et al. ..... 524/837

FOREIGN PATENT DOCUMENTS

JP 60-021111 2/1985
JP 03-012498 1/1991

(Continued)

*Primary Examiner* — Taiwo Oladapo
(74) *Attorney, Agent, or Firm* — Clark & Brody

(57) ABSTRACT

The present invention provide a two-component anti-seizure agent for hot metal working process comprising the first aqueous solution and the second aqueous solution, wherein the first aqueous solution contains 10~30 mass % of sodium silicate equivalent to anhydride to 100 mass % of total mass of the first aqueous solution, and the second aqueous solution contains at least one kind selected from a group consisting of: an organic acid and water-soluble amine salts thereof, an inorganic acid and water-soluble amine salts thereof, a water-soluble amine, a water-soluble alcohol, and a water-soluble metal chloride. When the two-component anti-seizure agent is applied onto disk-roll type guide shoes, it can be provided and maintained on the circumferential surface of the disk-roll type guide shoes without washed away by rolls' cooling water. Thereby, the anti-seizure agent does not adhere to rolls and the rolls and a pipe material do not cause slippage each other. Thus, it is capable to carry out piercing-rolling of the pipe material.

3 Claims, 1 Drawing Sheet

(52) U.S. Cl.
CPC ... *C10M2201/081* (2013.01); *C10M 2201/085* (2013.01); *C10M 2201/087* (2013.01); *C10M 2201/102* (2013.01); *C10M 2207/021* (2013.01); *C10M 2207/121* (2013.01); *C10M 2207/122* (2013.01); *C10M 2207/124* (2013.01); *C10M 2207/126* (2013.01); *C10M 2207/127* (2013.01); *C10M 2209/084* (2013.01); *C10M 2209/12* (2013.01); *C10M 2215/02* (2013.01); *C10M 2215/042* (2013.01); *C10N 2210/02* (2013.01); *C10N 2210/03* (2013.01); *C10N 2230/06* (2013.01); *C10N 2240/403* (2013.01); *C10N 2240/404* (2013.01)

(56) References Cited

FOREIGN PATENT DOCUMENTS

| | | | | |
|---|---|---|---|---|
| JP | 04-288916 | | | 10/1992 |
| JP | 05-117684 | | | 5/1993 |
| JP | 10-130687 | | | 5/1998 |
| JP | 10-130687 | A | * | 5/1998 |
| JP | 11-035967 | | | 2/1999 |
| JP | 11035967 | A | * | 2/1999 |
| JP | 2002172409 | A | * | 6/2002 |

* cited by examiner

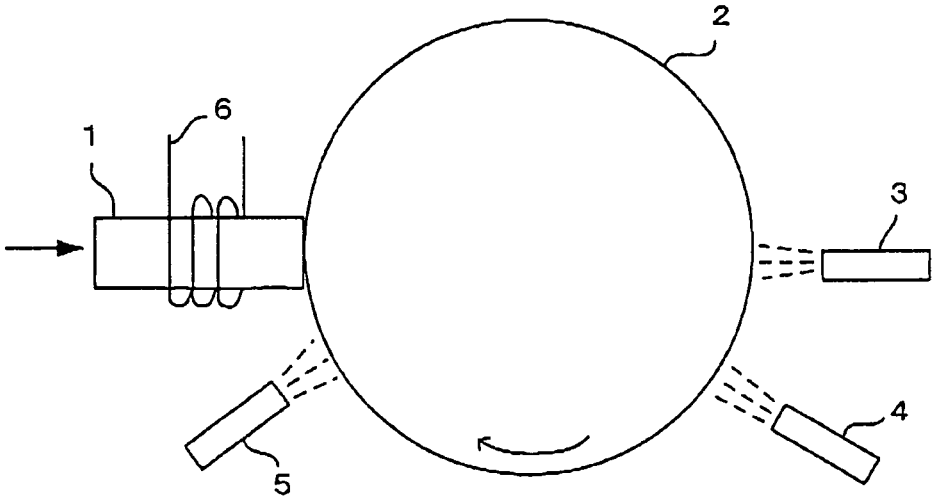
2
6
1
3
4
5

TWO-COMPONENT ANTI-SEIZURE AGENT FOR HOT METAL WORKING PROCESS, AND METHOD OF MANUFACTURING SEAMLESS PIPE USING THEREOF

RELATED APPLICATION

This application is a national stage entry of PCT/JP06/02280, filed Feb. 9, 2006, which claims priority from Japanese Patent Application No. 2005-033015, filed Feb. 9, 2005, which are incorporated by reference in their entirety.

TECHNICAL FIELD

The present invention relates to a two-component anti-seizure agent for hot metal working process for inhibiting seizing between guide shoes and a pipe or a tube (hereinafter, refer to "a pipe" as "a pipe or a tube".) in a piercing-rolling process of seamless pipe production using a piercing-rolling mill having disk-roll type guide shoes, particularly a piercing-rolling mill having transverse disk-roll type guide shoes of which rotational axis is vertical to the surface of the earth. Also, the present invention relates to a method of manufacturing seamless pipe using the anti-seizure agent.

BACKGROUND ART

When seamless pipe production by hot rolling is carried out by Mannesmann process, it is well-known that seizing flaw called "shoe mark" is produced on the surface of seamless pipe during piercing-rolling process of a seamless pipe using a piercing-rolling mill because of the contact between the material for seamless pipe (hereinafter, it may be referred to "pipe material".) and guide shoes of the piercing-rolling mill.

In order to solve this problem, for example, Patent document 1 discloses a piercing-rolling method where a mixed liquid type coating material (which is provided by adding sodium silicate (water glass) as a binder to metal oxide particles such as iron oxide) is applied onto the circumferential surface of guide shoes. In addition, Patent document 2 discloses lubricants for hot process composed of an aqueous solution containing an iron oxide, a sodium silicate, a starch, and a xanthan gum.

Moreover, Patent document 3 discloses a hot-rolling method to form a coating onto guide shoes and so on by applying a coat-forming solution mainly containing aqueous polymer salt prepared by non-aqueous polymeric acid and a coat-forming supplementary solution containing strong acid or aluminum salt thereof as the main component to make coating component in the polymer salt deposit from the coat-forming solution.

Patent Document 1: Japanese Patent Application Laid-Open (JP-A) No. 60-21111

Patent Document 2: JP-A No. 11-35967

Patent Document 3: JP-A No. 4-288916

DISCLOSURE OF THE INVENTION

Problems to be Solved by the Invention

However, the mixed liquid type coating material described in Patent document 1 does not sufficiently adhere to the circumferential surface of guide shoes, it is assumed that seizing cannot be inhibited.

Further, although the lubricants described in Patent document 2 can actually sufficiently adhere to guide shoes, in a case when rolls' cooling water for inhibiting wear of rolls of the piercing-rolling mill splashes the guide shoes, there is assumedly a problem that the lubricant once adhered onto the circumferential surface of the guide shoes runs off. Specifically, in a piercing-rolling mill having transverse disk-roll type guide shoes, large amount of rolls' cooling water for cooling the rolls being arranged in an upper position falls on the disk-roll type guide shoes; a problem that the adhered lubricant on the circumferential surface of the guide shoes run s off is expected.

Because of this, when piercing-rolling is carried out with pipe materials made of extremely easy to seize materials like stainless steel, it is difficult to inhibit the seizing. When supply of rolls' cooling water is stopped during piercing-rolling process so as to inhibit running off of lubricant by the rolls' cooling water, the lubricant adheres to the rolls, and that causes a problem of slippage between the rolls and a pipe material. Moreover, the coat-forming method described in Patent document 3 is assumed that it cannot form a necessary coating for inhibiting seizing.

Accordingly, an object of the present invention is to provide an anti-seizure agent which is capable not to be easily washed away once adhered to the contact surface between a pipe material and guide shoes; not to adhere to the rolls, for the anti-seizure agent which adhered to the contact surface between a pipe material and guide shoes; and to inhibit occurrence of flaws without causing slippage between the rolls and a pipe material. Another object of the present invention is to provide a method of manufacturing seamless pipe using the anti-seizure agent.

Means for Solving the Problems

The present invention is an anti-seizure agent which is used for hot-rolling, it is necessary to be a water soluble material with no danger of fire, and to be a water-proof material after application onto the circumferential surface of disk-roll type guide shoes. The present inventors have been carried out serious studies on anti-seizure agents which meet such requirements. As a result, the following invention has been obtained.

The first aspect of the present invention is a two-component anti-seizure agent for hot metal working process comprising the first aqueous solution and the second aqueous solution, wherein the first aqueous solution contains 10~30 mass % of sodium silicate equivalent to anhydride to total mass (100 mass %) of the first aqueous solution, and the second aqueous solution contains at least one kind selected from a group consisting of: an organic acid and water-soluble amine salts thereof, an inorganic acid and water-soluble amine salts thereof, a water-soluble amine, a water-soluble alcohol, and a water-soluble metal chloride.

The wording "two-component" means a type of anti-seizure agent to be used in the following procedure. As it were, at a time of storage of this anti-seizure agent, the first aqueous solution and the second aqueous solution are not mixed but separately stored. When the anti-seizure agent is used, the first aqueous solution and the second aqueous solution are respectively applied onto the guide shoes; these two aqueous solutions then contact each other for the first time.

The first aqueous solution may contain 10~30 mass % of sodium silicate equivalent to anhydride, 10~60 mass % of iron oxide, 0~5 mass % of modified starch, and 0~1 mass % of shear-rate dependent viscosity reducer, to total mass (100 mass %) of said first aqueous solution.

The wording "shear-rate dependent viscosity reducer" means a generic name of compounds having the following property. That is, a solution, which dissolved this particular compound in a solvent such as water, has the property such that when shear force is given with increasing shear-rate, the viscosity of the solution is reduced, and when the shear force is removed, the viscosity of the solution recovers.

The shear-rate dependent viscosity reducer is preferably a xanthan gum.

The second aspect of the invention is a method of manufacturing seamless pipe using a piercing-rolling mill having disk-roll type guide shoes, the method comprising the steps of: the first process for applying the first aqueous solution to the circumferential surface of the disk-roll type guide shoes, and the second process for applying the second aqueous solution to the circumferential surface of the disk-roll type guide shoes to form the water-proof coating on the circumferential surface, wherein the first aqueous solution contains 10~30 mass % of sodium silicate equivalent to anhydride to total mass (100 mass %) of the first aqueous solution, and the second aqueous solution contains at least one kind selected from a group consisting of: an organic acid and water-soluble amine salts thereof, an inorganic acid and water-soluble amine salts thereof, a water-soluble amine, a water-soluble alcohol, and a water-soluble metal chloride.

In the above method of manufacturing seamless pipe, the first aqueous solution preferably contains 10~30 mass % of sodium silicate equivalent to anhydride, 10~60 mass % of iron oxide, 0~5 mass % of modified starch, and 0~1 mass % of shear-rate dependent viscosity reducer, to total mass (100 mass %) of said first aqueous solution. In addition, the shear-rate dependent viscosity reducer is preferably a xanthan gum.

Effects of the Invention

According to the two-component anti-seizure agent for hot metal working process of the present invention, the anti-seizure agent applied to the disk-roll type guide shoes is provided to the circumferential surface of the disk-roll type guide shoes being a contact surface between a pipe material and guide shoes and is maintained on the circumferential surface. Further, the anti-seizure agent is not washed away by rolls' cooling water, it does not run off to adhere to the rolls. Furthermore, according to the method of manufacturing seamless pipe using this anti-seizure agent, the rolls and a pipe material do not cause slippage each other, thereby it is capable to carry out piercing-rolling of the pipe material. Therefore, it is capable to manufacture a seamless pipe which does not have seizing flaw thereby the pipe is excellent in the surface quality.

BRIEF DESCRIPTION OF THE DRAWINGS

FIG. 1 is a diagrammatic view showing a test method for evaluation of seizing.

DESCRIPTION OF THE REFERENCE NUMERALS

1 member
2 roll material
3 nozzle (for the first aqueous solution)
4 nozzle (for the second aqueous solution)
5 nozzle (for water)
6 high-frequency coil

BEST MODE FOR CARRYING OUT THE INVENTION

The two-component anti-seizure agent for hot metal working process of the present invention is composed of two solutions, i.e. the first aqueous solution and the second aqueous solution. The first aqueous solution is applied to the portion where guide shoes and a pipe material contact each other, then the second aqueous solution is applied thereon so as to form a water-proof coating in this portion. Thereby it is capable to inhibit seizing of the pipe material.

The first aqueous solution contains 10~30 mass % of sodium silicate equivalent to anhydride to total mass (100 mass %) of the first aqueous solution.

Sodium silicate is commercially available in a form of water glass in which sodium silicate is combined with water and which usually contains 45~70 mass % of water. Sodium silicate becomes hardened when it reacts with the second aqueous solution described below to form a water-proof coating.

Content of sodium silicate is, to the total mass (100 mass %) of the first aqueous solution, preferably 10~30 mass %, more preferably 15~25 mass % equivalent to anhydride. Because, when the content of sodium silicate is too small, curing reaction is not sufficiently proceeded; therefore seizing cannot be inhibited sufficiently. On the other hand, when the content of sodium silicate is too large, excess sodium silicate causes too much lubricity. The friction coefficient declines, thus there is a fear of occurrence of roll slippage.

Kind of sodium silicate is not specifically limited. For example, common water glass such as water glass of JIS (Japanese Industrial Standards) No. 1 ($Na_2O.2SiO_2$), water glass of JIS No. 3 ($Na_2O.3SiO_2$), water glass of JIS No. 4 ($Na_2O.4SiO_2$) can be used. With use of any one of these sodium silicates, by adjusting the amount thereof within the above range, the two-component anti-seizure agent for hot metal working process of the invention can realize the designed performance.

Other than the above predetermined ratio of sodium silicate, the first aqueous solution may contain 10~60 mass % of iron oxide, 0~5 mass % of modified starch, and 0~1 mass % of shear-rate dependent viscosity reducer, to total mass (100 mass %) of the first aqueous solution.

Iron oxide is contained in order to realize a function as an anti-seizure agent. Such anti-seizure agent needs to exhibit favorable storage stability and sprayability; the particle diameter of iron oxide is preferably 0.1~10 μm. Because, when the particle diameter of iron oxide is too large, the storage stability and sprayability are deteriorated. While, the particle diameter of the same is too small, seizing cannot be inhibited sufficiently.

Content of iron oxide is, to the total mass (100 mass %) of the first aqueous solution, preferably 10~60 mass %, more preferably 20~40 mass %. When the content of iron oxide is too small, seizing cannot be inhibited sufficiently. While, the content of the same is too large, density and viscosity of the anti-seizure agent become too high, thereby sprayability thereof is deteriorated.

Kind of iron oxide may be any one of hematite ($Fe_2O_3$), magnetite ($Fe_3O_4$), or wustite (FeO); these may be used alone or in combination of two or more thereof.

Modified starch has a property of thermal gelatinization at high temperatures (usually 80° C. or more). This property contributes to prevent running off of the first aqueous solution applied to the surface of guide shoes being hot. However, when the second aqueous solution is applied before the first aqueous solution to run off, addition of the modified starch is not necessary.

When modified starch is mixed, the content is, to the total mass (100 mass %) of the first aqueous solution, preferably 5 mass % or less, more preferably within the range of 1~4 mass %. Because, when the content of modified starch is too large, friction coefficient of the anti-seizure agent declines, thus there is a fear of occurrence of roll slippage.

As the modified starch, for example, there may be dextrin, oxidized starch, soluble starch, etherified starch, and esterified starch. These may be used alone or in combination with two or more thereof.

As the shear-rate dependent viscosity reducer, xantham gum is preferably used. Xantham gum is a polysaccarides of about 2 million molecular weight having two glucoses, two mannoses, and two glucuronic acids as the constituent unit. The glucuronic acid is usually salt of K (potassium), Na (sodium), or Ca (calcium). As the xantham gum, generally available commercial items can be used.

Xantham gum becomes high viscosity because of the entanglement of the molecule chains when the solution is in a static state; on the contrary, xantham gum has thixotropic property where it becomes low viscosity because of the relaxation of entanglement of the molecule chains when the solution is in a kinetic status. Depends on the addition thereof to the first aqueous solution, it is possible to control the viscosity of the first aqueous solution in a kinematical way. In other words, when the first aqueous solution is stored or is located in an area such as inner area of piping of a spray apparatus before spray application to guide shoes, the first aqueous solution is in a static status and is high viscosity. Therefore it is stable.

While, when spray of the first aqueous solution is applied onto the surface of guide shoes, shear force is added to the first aqueous solution thereby the solution becomes kinetic. Because of this, viscosity of the first aqueous solution becomes low and viscosity resistance of the same in the piping also becomes low. Therefore, it is capable to spray the first aqueous solution smoothly. Moreover, once the first aqueous solution sprayed is adhered to the surface of guide shoes to be in a static state, the solution immediately recovers high viscosity thereby it does not run off from the surface of guide shoes. If methods such as providing agitation apparatus with a storage tank or reducing amount of water content, shear-rate dependent viscosity reducer like xantham gum and so on is not necessarily used.

When a shear-rate dependent viscosity reducer is added, the content thereof is preferably 1 mass % or less, more preferably within the range of 0.05~0.8 mass %. If the content of the shear-rate dependent viscosity reducer is excessive, the viscosity thereof becomes too high and spray cannot be appropriately applied.

Other than the above-mentioned components, in the degree which doesn't damage the effect of anti-seizure agent of this invention, it is capable to add dispersant or rust inhibitor generally used in an aqueous solution containing solid particles like general anti-seizure agent to the first aqueous solution.

As water, when the amount is too small, smooth spray cannot be made; while, when the amount of water is excessively large, the first aqueous solution tends to run off from the surface of guide shoes. Therefore, total amount of water including water contained in water glass and another water to be added is, to total mass of the first aqueous solution (100 mass %), preferably 24.0~84.5 mass %, more preferably 40~70 mass %. In the invention, it is preferable to optimize the viscosity of the first aqueous solution and maintain the appropriate solvency by adjusting the amount of water in this way.

The second aqueous solution contains at least one kind selected from a group consisting of: an organic acid and water-soluble amine salts thereof, an inorganic acid and water-soluble amine salts thereof, a water-soluble amine, a water-soluble alcohol, and a water-soluble metal chloride.

As an organic acid, it is preferable to use one whose total acid number is 500 mgKOH/g or more. Specifically, it is preferable to use a monobasic acid such as formic acid, acetic acid, and lactic acid; a dibasic acid such as oxalic acid, malonic acid, maleic acid, malic acid, and tartaric acid; a tribasic acid such as citric acid.

The wording "total acid number" means, as described in JIS K 2501 (Petroleum products and lubricants-Determination of Neutralization number), "value in milligram (mg) of potassium hydroxide necessary for neutralize total acid component contained in 1 g of sample".

As the second aqueous solution, it is possible to use a liquid substance just as it is, or to use a solid substance dissolved in water at a limit concentration. In order to give fire resistance to the second aqueous solution, it is preferable to be used as 5~30 mass % of water solution.

Water-soluble amine salts of organic acid are, together with the amine salt of the above-mentioned organic acids, an organic acid of which amine salt is to become water-soluble, for instance, amine salt of dibasic acid such as succinic acid, glutaric acid, adipic acid, phthalic acid; and amine salt of tribasic acid such as trimellitic acid. Examples of amine of water-soluble amine salt of organic acid include; amino alcohol such as monoethanol amine, diethanol amine, triethanol amine, monoisopropanol amine, diisopropanol amine, triisopropanol amine, N-(β-aminoethyl) ethanol amine, N-methyl diethanol amine; and ammonia, and so on.

Examples of an inorganic acid include hydrochloric acid, sulfuric acid, phosphoric acid. As the second aqueous solution, it is possible to use a liquid substance just as it is, or to use a solid substance dissolved in water at limit concentrations. In order to secure safety to the human body, these second aqueous solutions are preferably used as 1~20 mass % solution.

Examples of water-soluble amine salts of an inorganic acid include inorganic acids such as hydrochloric acid, sulfuric acid, phosphoric acid, boric acid, molybdenum acid, and tungsten acid; and salts with amine in water-soluble amine salts of the above organic acids.

As a water-soluble amine, there may be amino alcohol shown as amine in water-soluble amine salts of the above organic acids.

Examples of water-soluble alcohol include methyl alcohol, ethyl alcohol, isopropyl alcohol, diethyleneglycol ethylether, ethyleneglycol butylether.

Examples of metal chloride include iron chloride, calcium chloride, magnesium chloride, and aluminum chloride. The water-soluble metal chloride is, from the view point of safety and solvency, desirably used as 5~50 mass % aqueous solution.

The second aqueous solution may contain two or more kinds of each of the above component. In that case, an aqueous solution whose total sum of each component adjusted to be 10~50 mass % is desirably used.

Method for inhibiting seizing of seamless pipes at a time of piercing-rolling of the present invention, in a process of piercing-rolling of a pipe material using tilted-roll piercing-rolling mill having disk-roll type guide shoes, has the first process for applying the first aqueous solution to a circumferential surface of the disk-roll type guide shoes, and the second process for applying the second aqueous solution to the circumferential surface of the disk-roll type guide shoes to have a waterproof coating on the circumferential surface.

The first aqueous solution to be used in the first process is same as the first aqueous solution for the above two-component anti-seizure agent for hot metal working process; and second aqueous solution used in the second process is same as the second aqueous solution for the above two-component anti-seizure agent for hot metal working process.

In the method of manufacturing seamless pipe of the invention, it is assumed that sodium silicate in the first aqueous solution reacts with the second aqueous solution and become gelatinized, thereby a water-proof coating is formed on the surface of the disk-roll type guide shoes. As a result, the anti-seizure agent is kept on the circumferential surface of the disk-roll type guide shoes without being washed away by the rolls' cooling water. Thus, it is capable to inhibit seizing of pipe materials and capable to produce seamless pipes which do not have seizing flaws and which is excellent in surface property.

In the piercing-rolling mill having transverse disk-roll type guide shoes whose rotational axis is vertical to the surface of the earth, large amount of the rolls' cooling water for cooling the tilted rolls splashs to the disk-roll type guide shoes. Hence, the method of inhibiting seizing of the invention can be suitably used specifically for such a piercing-rolling mill having transverse disk-roll type guide shoes.

The circumferential surface of the disk-roll type guide shoes onto which the first aqueous solution and the second aqueous solution is applied is a circumferential side surface of disk-shaped disk-roll type guide shoes. Usually, this circumferential side surface is half-moon shape in longitudinal section along the shape of pipe materials to be piercing-rolled.

In the first process, the first aqueous solution is applied onto the circumferential surface of the disk-roll type guide shoes so as the amount of application to be 50~500 g/m$^2$, preferably 100~400 g/m$^2$. Then, the second aqueous solution is applied onto the above circumferential surface of the disk-roll type guide shoes so as the amount of application to be 30~300 g/m$^2$, preferably 50~200 g/m$^2$. Because, if the application amount of the first aqueous solution is too small, component for inhibiting seizing lacks thereby sufficient seizing inhibiting effect cannot be obtained. Further, if the application amount of the first aqueous solution is excessive, the second aqueous solution cannot sufficiently gelatinize the first aqueous solution, therefore favorable water-proof coating cannot be formed.

In the second process, it is desirable to apply the second aqueous solution of which application amount is a half of that of the first aqueous solution. Because, if the application amount of the second aqueous solution is too small, it cannot sufficiently gelatinize the first aqueous solution. On the other hand, if the application amount of the second aqueous solution is excessive, gelatinization effect is saturated, therefore it is economically disadvantageous.

The application method of the first aqueous solution and the second aqueous solution is not particularly limited, the method may include brush coating and spray coating. In order to uniformly apply these solutions onto the circumferential surface of the disk-roll type guide shoes, use of spray is preferable.

Materials for the seamless pipe, where the method of manufacturing seamless pipe of the invention can be applied, is not particularly limited. This method is remarkably effective especially to the materials (like stainless steel) which are easily seized.

EXAMPLES

Hereinafter, the present invention will be described in detail with reference with "production examples" and "examples".

Production Examples (1-1)~(1-6)

Iron oxide (chemical formula: $Fe_2O_3$, purity: 98%, average particle diameter: 0.3 μm), sodium silicate (chemical formula: $Na_2O.2SiO_2$), modified starch (British gum 140, produced by Matsutani Chemical Industry Co,. Ltd.), xantham gum (trade name "KELZAN", produced by CP Kelco), and water were mixed based on the ratio shown in Table 1 to obtain the first aqueous solution. In Table 1, the value of each component is represented by mass % to total (100 mass %) of the first aqueous solution.

TABLE 1

| | Production example (1-1) | Production example (1-2) | Production example (1-3) | Production example (1-4) | Production example (1-5) | Production example (1-6) |
|---|---|---|---|---|---|---|
| iron oxide | 10.0 | 20.0 | 30.0 | 40.0 | 60.0 | 10.0 |
| sodium silicate | 30.0 | 20.0 | 10.0 | 15.0 | 15.0 | 20.0 |
| modified starch | — | 2.0 | 4.0 | 1.0 | 3.0 | — |
| xantham gum | 0.5 | 0.2 | 0.2 | 0.1 | — | 0.9 |
| water | 59.5 | 57.8 | 56.8 | 43.9 | 22.0 | 69.1 |

Production Examples (2-1)~(2-14)

A solution which contains each component shown in Table 2 based on the ratio shown in Table 2 was used as the second aqueous solution. In Table 2, the value of each component is represented by mass % to total (100 mass %) of the second aqueous solution. In Production example (2-14), commercially available aqueous solution (produced by Taimei Chemicals Co., Ltd., trade name "Taipac" (concentration: 10~11 mass % equivalent to $Al_2O_3$)) was used as it is.

TABLE 2

| | Production example (2-1) | Production example (2-2) | Production example (2-3) | Production example (2-4) | Production example (2-5) | Production example (2-6) | Production example (2-7) |
|---|---|---|---|---|---|---|---|
| acetic acid | 20.0 | 36.0 | — | — | — | — | — |
| oxalic acid | — | — | 10.0 | — | — | — | — |
| adipic acid | — | — | — | 10.0 | — | — | — |

TABLE 2-continued

| | | | | | | | |
|---|---|---|---|---|---|---|---|
| tartaric acid | — | — | — | — | 20.0 | — | — |
| hydrochloric acid | — | — | — | — | — | 10.0 | — |
| phosphoric acid | — | — | — | — | — | — | 20.0 |
| boric acid | — | — | — | — | — | — | — |
| monoethanol amine | — | 36.0 | — | 6.4 | — | — | — |
| N-methyl diethanol amine | — | — | — | — | — | — | — |
| methyl alcohol | — | — | — | — | — | — | — |
| iron chloride | — | — | — | — | — | — | — |
| magnesium chloride | — | — | — | — | — | — | — |
| basic aluminum chloride | — | — | — | — | — | — | — |
| water | 80.0 | 28.0 | 90.0 | 83.6 | 80.0 | 90.0 | 80.0 |

| | Production example (2-8) | Production example (2-9) | Production example (2-10) | Production example (2-11) | Production example (2-12) | Production example (2-13) | Production example (2-14) |
|---|---|---|---|---|---|---|---|
| acetic acid | — | — | — | — | — | — | — |
| oxalic acid | — | — | — | — | — | — | — |
| adipic acid | — | — | — | — | — | — | — |
| tartaric acid | — | — | — | — | — | — | — |
| hydrochloric acid | — | — | — | — | — | — | — |
| phosphoric acid | — | — | — | — | — | — | — |
| boric acid | 50.0 | — | — | — | — | — | — |
| monoethanol amine | 17.0 | 70.0 | — | — | — | — | — |
| N-methyl diethanol amine | — | — | 50.0 | — | — | — | — |
| methyl alcohol | — | — | — | 60.0 | — | — | — |
| iron chloride | — | — | — | — | 20.0 | — | — |
| magnesium chloride | — | — | — | — | | 20.0 | — |
| basic aluminum chloride | — | — | — | — | — | — | 10~11 |
| water | 33.0 | 30.0 | 50.0 | 40.0 | 80.0 | 80.0 | 89~90 |

Comparative Production Examples (1-1)~(1-7)

A solution which contains each component shown in Table 3 based on the ratio shown in Table 3 was used as the first aqueous solution. Individual material of iron oxide, sodium silicate, modified starch, and xantham gum to be used were the same as those of production example (1-1). As ammonium salts of isobutylene maleic acid co-polymer, a material such that weight-average molecular weight 80,000~90,000 of an isobutylene maleic acid co-polymer was neutralized with ammonia was used. As polyacrylic acid sodium salt, a material whose weight-average molecular weight is about 500,000 was used; and as carboxy methylcellose, a sodium salt whose weight-average molecular weight is 10,000~15,000 was used. The value of each component in Table 1 is represented by mass % to total (100 mass %) of the first aqueous solution. In addition, in the case of Comparative Production example (1-4), ammonium borate was deposited at room temperature; however it was dissolved by heat.

TABLE 3

| | Comparative Production example (1-1) | Comparative Production example (1-2) | Comparative Production example (1-3) | Comparative Production example (1-4) | Comparative Production example (1-5) | Comparative Production example (1-6) | Comparative Production example (1-7) |
|---|---|---|---|---|---|---|---|
| iron oxide | 5.0 | 30.0 | 5.0 | — | 20.0 | 30.0 | — |
| sodium silicate | 4.0 | 3.0 | 30.0 | — | — | — | — |
| modified starch | 2.0 | — | 1.0 | — | — | — | — |
| xantham gum | 0.5 | 0.005 | 0.1 | — | — | — | — |
| ammonium salt of Isobutylene maleic acid copolymer | — | — | — | 5.0 | — | — | — |

TABLE 3-continued

| | Comparative Production example (1-1) | Comparative Production example (1-2) | Comparative Production example (1-3) | Comparative Production example (1-4) | Comparative Production example (1-5) | Comparative Production example (1-6) | Comparative Production example (1-7) |
|---|---|---|---|---|---|---|---|
| polyacrylic add sodium salt | — | — | — | — | 15.0 | — | — |
| ammonium borate | — | — | — | 15.0 | — | — | — |
| boric acid amino salt | — | — | — | — | — | — | 15.0 |
| carboxy methylcellose | — | — | — | — | — | 9.0 | 0.5 |
| water | 88.5 | 66.995 | 63.9 | 80.0 | 65.0 | 61.0 | 84.5 |

Comparative Production Examples (2-1)~(2-6)

A solution which contains each component shown in Table 4 based on the ratio shown in Table 4 was used as the second aqueous solution. The value of each component in Table 4 is represented by mass % to total (100 mass %) of the second aqueous solution. Caproic acid and oleic acid to be used in the Comparative Production example (2-1) and Comparative Production example (2-2) are organic acids of which total acid number is 500 mgKOH/g or less.

TABLE 4

| | Comparative Production example (2-1) | Comparative Production example (2-2) | Comparative Production example (2-3) | Comparative Production example (2-4) | Comparative Production example (2-5) | Comparative Production example (2-6) |
|---|---|---|---|---|---|---|
| caproic acid | 30.0 | — | — | — | — | — |
| oleic acid | — | 10.0 | — | — | — | — |
| ammonia | — | — | 25.0 | — | — | — |
| monoisopropanol amine | 6.4 | — | — | — | — | — |
| triethanol amine | — | 40.0 | — | — | — | — |
| glycerin | — | — | — | 50.0 | — | — |
| sodium chloride | — | — | — | — | 20.0 | — |
| sodium hydroxide | — | — | — | — | — | 25.0 |
| water | 63.6 | 50.0 | 75.0 | 50.0 | 80.0 | 75.0 |

Examples 1~16

A combination of the first aqueous solution and the second aqueous solution shown in Table 5 was prepared to make it the two-component anti-seizure agent for hot metal working process of the present invention. Then, the evaluation thereof was carried out in terms of curing and seizing resistance. The evaluation results are shown in Table 5.

Comparative Examples 1~17

A combination of the first aqueous solution and the second aqueous solution shown in Table 5 was prepared to make it the two-component anti-seizure agent for hot metal working process of the present invention. The first aqueous solution only (Comparative examples 10 and 11), or the second aqueous solution only (Comparative example 17) were also used as the anti-seizure agent for hot metal working process of the invention. Then, the evaluation thereof was done in terms of curing and seizing resistance. The evaluation results are shown in Table 5.

(Evaluation Methods)

(1) Curing

Curing was evaluated in accordance with the following procedure. Firstly, about 60 g/m$^2$ of the first aqueous solution was applied onto a glass plate, immediately after that, the glass plate to which the first aqueous solution been applied was dipped in the second aqueous solution for 1 second. Then, the glass plate was taken out from the second aqueous solution, and 1 second later, the surface of the glass plate was wiped off by waste cloth. The obtained glass plates were evaluated in accordance with the following criteria.

○: Coating formed on the glass plate was all remained

Δ: More than half of the coating formed on the glass plate was remained

χ: Coating formed on the glass plate was all removed, or the coating was not formed (2) Seizing Resistance Seizing resistance was evaluated in accordance with the following procedure. FIG. 1 is a diagrammatic view showing the test method. First of all, two-phase stainless steel (25Cr-7Ni-3Mo steel) member 1 is heated up to 1000° C. with use of high-frequency coil 6. Then, the first aqueous solution from nozzle 3 and later the second aqueous solution from nozzle 4 (depending on conditions, either one of the first aqueous solution only or the second aqueous solution only) were applied by spray application on the surface of alloyed cast-iron roll material 2 while the roll material 2 was rotated at 20 rpm rotation speed. Right before sliding of the member 1 on the surface of roll material 2, water was injected from nozzle 5 to the surface of the roll material 2. The member 1 was thrust onto the surface on the roll material 2 at 196N for 3 seconds (the period when the roll material 2 goes into a 360-degree roll). After the thrust, surface condition of the roll material 2 was evaluated in accordance with the following criteria.

○: Seizing could not be found even though the surface of roll material 2 was observed at 50 times magnification Δ: Seizing on the surface of roll material 2 was not found by visual observation, however minute seizing was observed when enlarged at 50 times magnification χ: Seizing was observed on the surface of roll material 2 by visual observation.

TABLE 5

| | Example | | Evaluation | |
|---|---|---|---|---|
| | the First aqueous solution | the Second aqueous solution | Curing | Seizing resistance |
| Example 1 | Production example 1-1 | Production example 2-1 | ○ | Δ |
| Example 2 | Production example 1-1 | Production example 2-3 | Δ | Δ |
| Example 3 | Production example 1-2 | Production example 2-1 | ○ | ○ |
| Example 4 | Production example 1-2 | Production example 2-2 | ○ | ○ |
| Example 5 | Production example 1-2 | Production example 2-4 | Δ | Δ |
| Example 6 | Production example 1-2 | Production example 2-5 | Δ | Δ |
| Example 7 | Production example 1-3 | Production example 2-7 | Δ | Δ |
| Example 8 | Production example 1-3 | Production example 2-8 | Δ | Δ |
| Example 9 | Production example 1-3 | Production example 2-12 | ○ | ○ |
| Example 10 | Production example 1-4 | Production example 2-9 | ○ | ○ |
| Example 11 | Production example 1-4 | Production example 2-10 | Δ | Δ |
| Example 12 | Production example 1-4 | Production example 2-14 | ○ | ○ |
| Example 13 | Production example 1-5 | Production example 2-6 | ○ | ○ |
| Example 14 | Production example 1-5 | Production example 2-8 | ○ | ○ |
| Example 15 | Production example 1-6 | Production example 2-11 | ○ | ○ |
| Example 16 | Production example 1-6 | Production example 2-13 | Δ | Δ |
| Comparative example 1 | Comparative Production example 1-1 | Production example 2-1 | x | x |
| Comparative example 2 | Comparative Production example 1-1 | Production example 2-3 | x | x |
| Comparative example 3 | Comparative Production example 1-2 | Production example 2-6 | x | x |
| Comparative example 4 | Comparative Production example 1-2 | Production example 2-8 | x | x |
| Comparative example 5 | Comparative Production example 1-3 | Production example 2-9 | ○ | x |
| Comparative example 6 | Comparative Production example 1-3 | Production example 2-12 | ○ | x |
| Comparative example 7 | Comparative Production example 1-4 | Production example 2-14 | x | x |
| Comparative example 8 | Comparative Production example 1-5 | Production example 2-14 | x | x |
| Comparative example 9 | Comparative Production example 1-6 | Production example 2-14 | x | x |
| Comparative example 10 | Comparative Production example 1-7 | None | x | x |
| Comparative example 11 | Production example 1-1 | None | x | x |
| Comparative example 12 | Production example 1-2 | Comparative Production example 2-1 | x | x |
| Comparative example 13 | Production example 1-3 | Comparative Production example 2-2 | x | x |
| Comparative example 14 | Production example 1-3 | Comparative Production example 2-3 | x | x |

TABLE 5-continued

| | Example | | Evaluation | |
|---|---|---|---|---|
| | the First aqueous solution | the Second aqueous solution | Curing | Seizing resistance |
| Comparative example 15 | Production example 1-4 | Comparative Production example 2-4 | x | x |
| Comparative example 16 | Production example 1-4 | Comparative Production example 2-5 | x | x |
| Comparative example 17 | None | Production example 2-5 | x | x |

The above has described the present invention associated with the most practical and preferred embodiments thereof. However, the invention is not limited to the embodiments disclosed in the specification. Thus, the invention can be appropriately varied as long as the variation is not contrary to the subject substance and conception of the invention which can be read out from the claims and the whole contents of the specification. It should be understood that a two-component anti-seizure agent for hot metal working process and a method of manufacturing seamless pipe using thereof with such an alternation are included in the technical scope of the invention.

INDUSTRIAL APPLICABILITY

The two-component anti-seizure agent for hot metal working process of the present invention can be used for inhibiting seizing between guide shoes and a pipe in the piercing-rolling process using a piercing-rolling mill having disk-roll type guide shoes, especially a piercing-rolling mill having transverse disk-roll type guide shoes whose rotational axis is vertical to the surface of the earth.

The invention claimed is:

1. A method of manufacturing seamless pipe using piercing-rolling mill having disk-roll type guide shoes, the method comprising the steps of:

a first process for applying, in a process of piercing-rolling, a first aqueous solution to a circumferential surface of said disk-roll type guide shoes, and a second process for applying a second aqueous solution to said circumferential surface of said disk-roll type guide shoes to form a water-proof coating on said circumferential surface in the process of piercing-rolling by gelling of the first aqueous solution, wherein said first aqueous solution contains 10~30 mass % of sodium silicate equivalent to anhydride to total mass of said first aqueous solution as 100 mass %, and said second aqueous solution contains at least one kind of component(s) selected from a group consisting of acetic acid, oxalic acid, adipic acid, tartaric acid, hydrochloric acid, phosphoric acid, boric acid, monoethanol amine, N-methyl diethanol amine, methyl alcohol, iron chloride, magnesium chloride, and basic aluminum chloride, and further wherein said first aqueous solution is substantially free from said acetic acid, oxalic acid, adipic acid, tartaric acid, hydrochloric acid, phosphoric acid, boric acid, monoethanol amine, N-methyl diethanol amine, methyl alcohol, iron chloride, magnesium chloride, and basic aluminum chloride included in said second aqueous solution, said second aqueous solution is substantially free from said sodium silicate included in said first aqueous solution and substantially free from organic acids of which total acid number is 500 mgKOH/g or less, and a total concentration of said component(s) in said second aqueous solution is 10-72 mass % based on a total mass of said second solution.

2. The method of manufacturing seamless pipe according to claim 1, wherein said first aqueous solution contains 10~30 mass % of sodium silicate equivalent to anhydride, 10~60 mass % of iron oxide, 0~5 mass % of modified starch, and 0~1 mass % of shear-rate dependent viscosity reducer, to total mass of said first aqueous solution as 100 mass %.

3. The method of manufacturing seamless pipe according to claim 2, wherein said shear-rate dependent viscosity reducer is a xanthan gum.

* * * * *